United States Patent [19]

Sasaki et al.

[11] Patent Number: 4,614,709

[45] Date of Patent: Sep. 30, 1986

[54] SILVER HALIDE PHOTOGRAPHIC LIGHT-SENSITIVE MATERIAL

[75] Inventors: Masao Sasaki; Kaoru Onodera, both of Odawara, Japan

[73] Assignee: Konishiroku Photo Industry Co., Ltd., Japan

[21] Appl. No.: 563,586

[22] Filed: Dec. 20, 1983

[30] Foreign Application Priority Data

Dec. 21, 1982 [JP] Japan ..... 57-225301

[51] Int. Cl.[4] ..... G03C 7/26; G03C 7/36; G03C 7/32

[52] U.S. Cl. ..... 430/546; 430/552; 430/553; 430/554; 430/555; 430/556; 430/557; 430/558; 430/505; 430/512

[58] Field of Search ..... 430/546, 556, 557, 558, 430/505, 512

[56] References Cited

U.S. PATENT DOCUMENTS

| | | | |
|---|---|---|---|
| 4,275,145 | 6/1981 | Mikami | 430/546 |
| 4,327,175 | 4/1982 | Toda et al. | 430/546 |
| 4,407,940 | 10/1983 | Nakamura et al. | 430/551 |
| 4,419,441 | 12/1983 | Nittel et al. | 430/512 |

*Primary Examiner*—Mary F. Downey

*Attorney, Agent, or Firm*—Finnegan, Henderson, Farabow, Garrett & Dunner

[57] ABSTRACT

A silver halide photographic light-sensitive material having a support with at least one silver halide emulsion layer is provided. The silver halide emulsion layer containing in combination at least one yellow dye image-forming coupler of Formula I and at least one high-boiling organic solvent of Formula II to reduce the light discoloration of a yellow dye image.

24 Claims, No Drawings

SILVER HALIDE PHOTOGRAPHIC LIGHT-SENSITIVE MATERIAL

BACKGROUND OF THE INVENTION

1. Field of the Invention

The present invention relates to a silver halide photographic light-sensitive material, and more particularly to a silver halide photographic light-sensitive material capable of forming a dye image whose yellow dye is remarkably improved on the resistance to light.

2. Description of the Prior Art

Of silver halide photographic light-sensitive materials (hereinafter referred to as photographic light-sensitive materials), in the black-and-white photographic light-sensitive material, the image formed therefrom is generally of matallic silver. In recent years, however, a silver-saving promotion has been taking place in an effort to cope with the shortage of silver resources and to reduce the cost of photographic light-sensitive materials. One of measures for solving this problem is the application of the color photographic technique that reproduces a neutral tone by mixing yellow, magenta and cyan dyes instead of using metallic silver.

In the field of color photographic techniques, it is already known that, for example, a coupler-containing photographic light-sensitive material, after being exposed to light, is processed in a color developer bath containing an aromatic primary amine-type color developing agent, thereby forming a dye image. Of the couplers used in the technique, the yellow dye image-forming coupler (hereinafter referred to as yellow coupler) has an active methylene radical useful for the formation of an yellow dye by the coupling reaction thereof with the oxidized product of an aromatic primary amine-type color developing agent. If the active methylene is unsubstituted (i.e., active site-unsubstituted-type yellow coupler), the coupler, because it requires 4 molecules of silver halide for the formation of its dye in a color developing reaction, is called a 4-equivalent coupler. On the other hand, it is also known that the same dye as in the unsubstituted-type coupler can also be formed from a coupler wherein one of the hydrogen atoms of the active methylene radical thereof is substituted by such a substituent component as a halogen atom, i.e., the so-called active site-substituted-type yellow coupler. In this instance, such the substituent component as a halogen atom splits off during a color developing reaction, and the coupler can form one molecule of its dye by two molecules of the developed silver halide, so that this coupler is called a two-equivalent coupler.

As the framework of yellow couplers, benzoylacetanilides were formerly widely used, but in recent years, particularly for color paper light-sensitive materials, pivaloylacetanilides have become mostly used. The transit into pivaloylacetanilides is considered mainly due to the fact that they are superior in the resistance to light of the image formed therefrom to benzoylacetanilides. However, even the yellow dye image derived from thus improved pivaloylacetanilides still not have any sufficient resistance to light for satisfying the social demand for the image preservability (the image lasting properties).

As the technique of improving the resistance to light of such the yellow dye image there are widely used such a method that, because the yellow dye image is inferior in the resistance particularly to the rays in the ultraviolet region, for the purpose of removing the ultraviolet rays, an ultraviolet absorbing agent is incorporated into the interlayer or the like of a photographic light-sensitive material. As the ultraviolet absorbing agent for this purpose there are known those 2-(2'-hydroxyphenyl)benzotriazole-type compounds as described in U.S. Pat. No. 3,253,921, Japanese Patent Examined Publication Nos. 10466/1961, 5496/1973 and 4157/1973, and Japanese Patent Publication Open to Public Inspection (hereinafter referred to as Japanese Patent O.P.I. Publication) No. 87326/1975. However, when any of these ultraviolet absorbing agents is used by being dispersed into a color photographic light-sensitive material, the agent not only has the disadvantage that because of its low solubility in organic solvents it is deposited into crystals to adversely affect the manufacturing process and photographic characteristics of the light-sensitive material, but, although useful for the protection from ultraviolet rays, is ineffective at all on the prevention of possible discoloration (same meaning of fading) by the light in the visible ray region, so that the addition of the agent exceeding a certain amount is practically meaningless.

On the other hand, there are also known the method for improving the resistance to light of the foregoing dye by rendering an antidiscoloration agent present under the environment of the formed dye, and as the antidiscoloration agent there are proposed the uses of bisphenols as disclosed in Japanese Patent Examined Publication Nos. 31256/1973 and 31625/1973; of 6-hydroxychromans as in U.S. Pat. Nos. 3,432,300 and 2,574,627; of 6,6'-dihydroxy-2,2'-disspirochromans as in Japanese Patent Examined Publication No. 20977/1974; of hydroquinone derivatives as in Japanese Patent Examined Publication No. 24257/1981; and of 4-hydroxybenzoate compounds as in Japanese Patent O.P.I. Publication No. 48535/1979. However, these compounds certainly have good effects on the improvement of the light resistance of magenta dyes, but has no effect at all on the yellow dye image, and on the contrary accelerate the light discoloration of the yellow dye. Japanese Patent O.P.I. Publication No. 65954/1980 proposes the presence of hindered amine-type compounds in the environment of the formed dye, but these compounds are so less soluble in organic solvents as to be deposited to adversely affect the manufacturing process of as well as the photographic characteristics of the light-sensitive material. Japanese Patent O.P.I. Publication No. 103551/1980 proposes a method for improving the resistance to light of an yellow dye image by the use in combination of a slightly-water-soluble hight-boiling organic solvent and a pivaloyl-type yellow coupler, but the method has the disadvantage that the gamma, as one of the sensitometric characteristics, becomes lowered.

Further, it is also well-known that the image preservability of a formed yellow dye image differs depending on the kind of generally used high-boiling organic solvents (having a boiling point of not less than 175° C.). Japanese Patent O.P.I. Publication No. 119922/1979 proposes the use in combination of an yellow coupler and a branched-chain alkyl phosphate-type high-boiling solvent, but the proposal is disadvantageous in respect that the light-resistance effect is extremely small.

It is therefore the status quo that any satisfactory method for improving the resistance to light of the yellow dye image of a color photographic light-sensitive material is still not found.

SUMMARY OF THE INVENTION

Objects of the Invention

It is therefore a first object of the present invention to provide a method which can be carried out conveniently for and which has a large effect upon improving the resistance to light of an yellow dye image.

It is a second object of the present invention to provide a photographic light-sensitive material which is remarkably improved on the anti-light-discoloration characteristic of the yellow dye image thereof.

It is a third object of the present invention to provide a method for improving the resistance to light of the yellow dye image without adversely affecting the manufacturing process of as well as the photographic characteristics of the photographic light-sensitive material.

It is a fourth object of the present invention to provide a method which can be carried out economically for improving the resistance to light of the yellow dye image and the stability of the yellow coupler dispersion.

Construction of the Invention

It has now been found that the above objects can be accomplished by the following silver halide photographic light-sensitive material: In a silver halide photographic light-sensitive material comprising a support having thereon at least one silver halide emulsion layer, the silver halide photographic light-sensitive material wherein the foregoing silver halide emulsion layer contains in combination at least one of those yellow dye image-formable couplers having the following Formula (I) and at least one of those high-boiling organic solvents having the following Formula (II):

Formula (I)

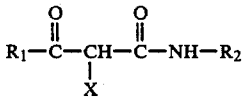

wherein $R_1$ represents an alkyl radical or an aryl radical; $R_2$ represents an aryl radical; and X is a hydrogen atom or a radical that can be split off by the reaction of the coupler with the oxidized product of an aromatic primary amine-type color developing agent, Formula (II)

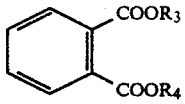

wherein $R_3$ and $R_4$ each is a nonyl radical, a decyl radical or an undecyl radical, the $R_3$ and $R_4$ being allowed to be either the same of different.

DETAILED DESCRIPTION OF THE INVENTION

In the present invention, the $R_1$, $R_2$ and X of the coupler having the foregoing Formula (I) (hereinafter referred to as the yellow coupler of the invention) are as defined in above, and the radicals represented by the $R_1$ include alkyl radicals such as, e.g., pivalyl and aryl radicals such as, e.g., phenyl, and preferably alkyl radicals, particularly pivalyl; the radicals represented by the $R_2$ are aryl radicals, preferably phenyl; and the radicals represented by the X which can be split off by the coupling reaction are preferably those having the following Formula (III) or (IV), and further, of those radicals having Formula (III), the particularly preferred are those having the following Formula (V) or (VI):

Formula (III)

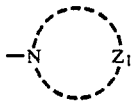

wherein $Z_1$ represents a group of nonmetallic atoms capable of forming a 4- to 7-member cyclic ring, $$-O-R_5$$ Formula (IV)

wherein $R_5$ is an aryl radical such as, e.g., phenyl, a heterocyclic radical or an acyl radical such as, e.g., acetyl, and the most preferred one is an aryl radical, Formula (V)

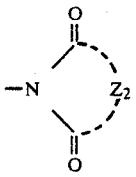

wherein $Z_2$ is a group of nonmetallic atoms capable of forming a 4- to 6-member ring together with Formula (VI)

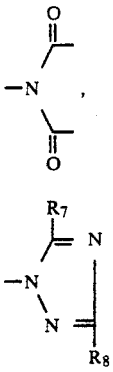

wherein $R_7$ and $R_8$ each is a hydrogen atom, a halogen atom (such as, e.g., chlorine), an alkyl radical (such as, e.g., methyl, ethyl, propyl), an alkenyl radical (such as, e.g, butenyl), an alkoxy radical (such as, e.g., methoxy), an aryl radical (such as, e.g., phenyl), a carboxy radical, an alkoxycarbonyl radical (such as, e.g., methoxycarbonyl), a carbamyl radical, a sulfone radical, a sulfamyl radical, a sulfonamido radical (such as, e.g., methanesulfonamido), an acylamido radical (such as, e.g., acetylamido), an ureido radical or an amino radical.

In Formula (I), the preferred yellow couplers of the present invention have the following Formula (VII):

Formula (VII)

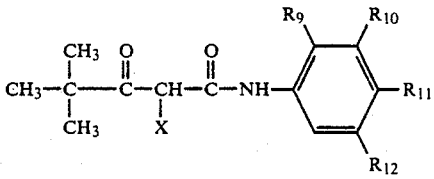

wherein $R_9$ is a hydrogen atom, a halogen atom (such as, e.g., chlorine) or an alkoxy radical (such as, e.g., methoxy, dodecyloxy), and preferably a halogen atom; $R_{10}$, $R_{11}$ and $R_{12}$ each is a hydrogen atom, a halogen atom (such as, e.g., chlorine), an alkyl radical (such as, e.g., methyl, ethyl, nonyl), an alkenyl radical, an alkoxy radical (such as, e.g., methoxy, dodecyloxy), an aryl radical (such as, e.g., phenyl), carboxyl radical, an alkoxycarbonyl radical (such as, e.g., methoxyhexadecenyl), a carbamyl radical, a sulfone radical, a sulfamyl radical, an alkylsulfonamido radical (such as, e.g., methanesulfonamido), an acylamido radical (such as, e.g., acetylamido), an ureido radical or an amino radical; and it is preferred that the $R_{10}$ and $R_{11}$ each is a hydrogen atom and the $R_{12}$ is an alkoxycarbonyl, acyalamido or alkylsulfonamido radical; and X is as defined in Formula (I), and preferably a radical having Formula (III) or (IV), and the more preferred one of Formula (III) is one having Formula (V) or (VI).

In Formula (I), those other preferred yellow couplers of the present invention have the following Formula (VIII):

Formula (VIII)

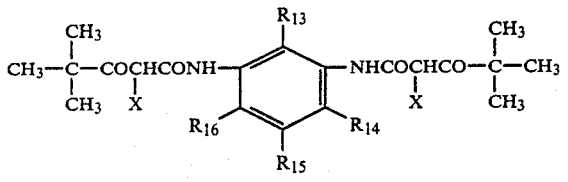

wherein $R_{13}$ is as defined in the $R_9$ of Formula (VII); $R_{14}$, $R_{15}$ and $R_{16}$ each is a hydrogen atom, a halogen atom (such as, e.g., chlorine), an alkyl radical (such as, e.g., methyl, nonyl), an alkenyl radical, an alkoxy radical (such as, e.g., methoxy, dodecyloxy), an aryl radical (such as, e.g., phenyl), a carboxyl radical, an alkoxycarbonyl radical (such as, e.g, methoxycarbonyl, decenyloxycarbonyl), a carbamyl radical, a sulfone radical, a sulfamyl radical, a sulfonamido radical (such as, e.g., methanesulfonamido), an acylamido radical (such as, e.g., acetylamido), an unreido radical or an amino radical; and X is as defined in Formula (I), and preferably a radical having Formula (III) or (IV), and the more preferred of Formula (III) is one having (V) or (VI).

The following are typical examples of the yellow couplers of the present invention, but the yellow couplers of the present invention are not limited thereto:

(Y-1)

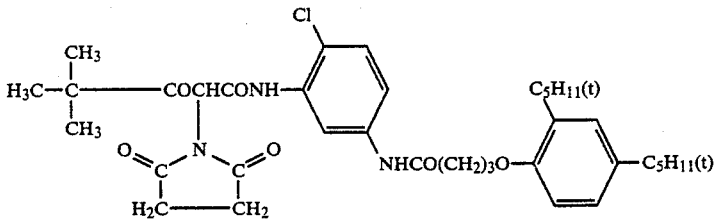

(Y-2)

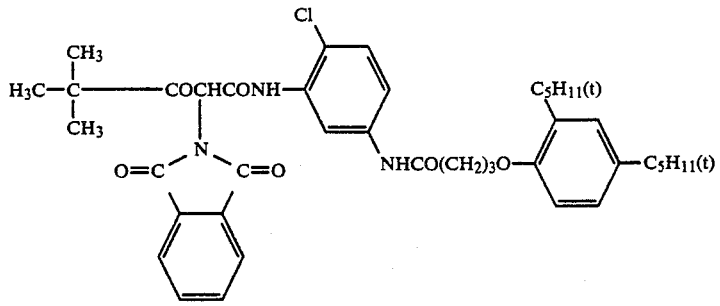

(Y-3)

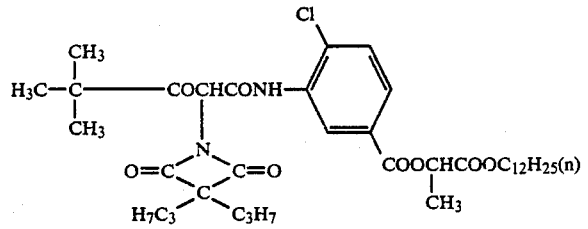

-continued
(Y-4)
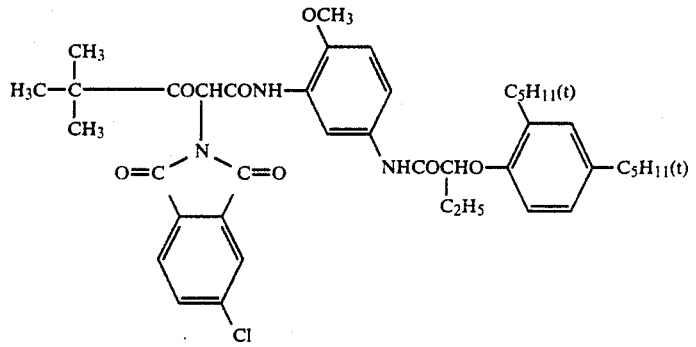
(Y-5)
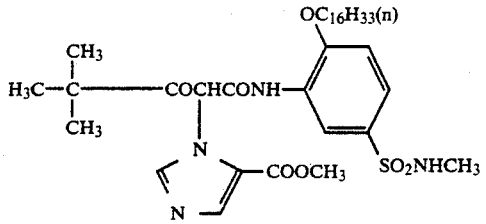
(Y-6)
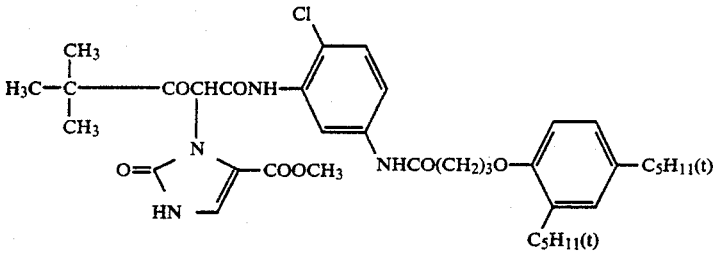
(Y-7)
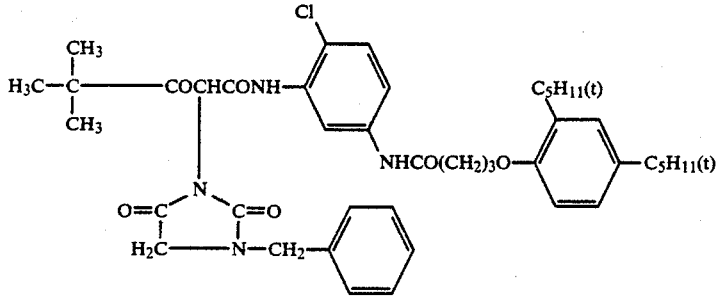
(Y-8)
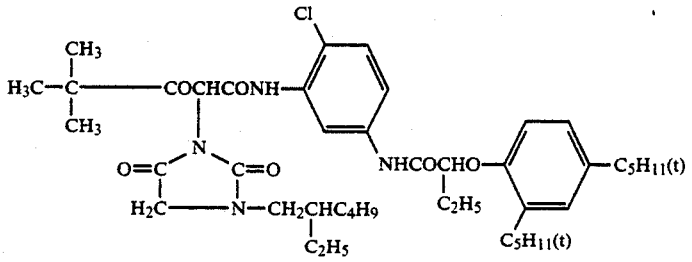
(Y-9)
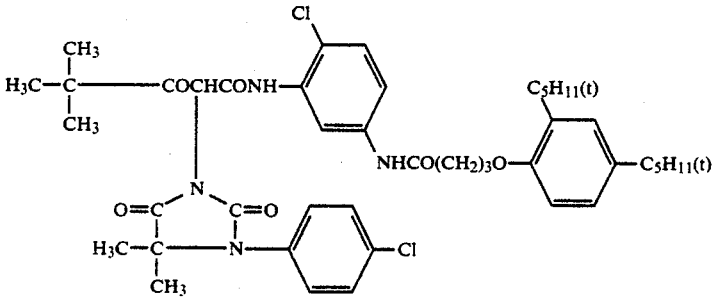

-continued
(Y-10)
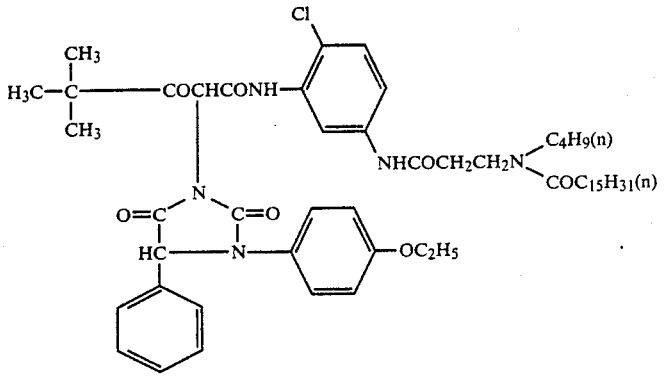
(Y-11)
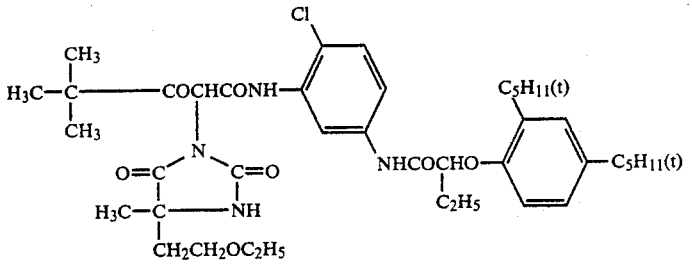
(Y-12)
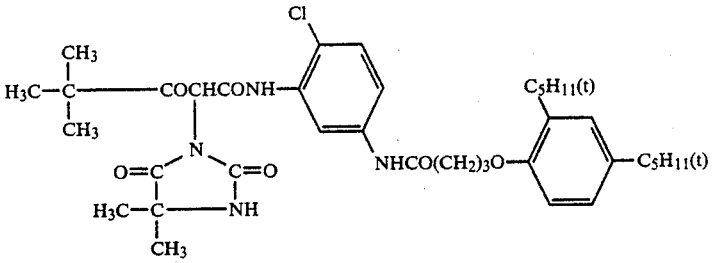
(Y-13)
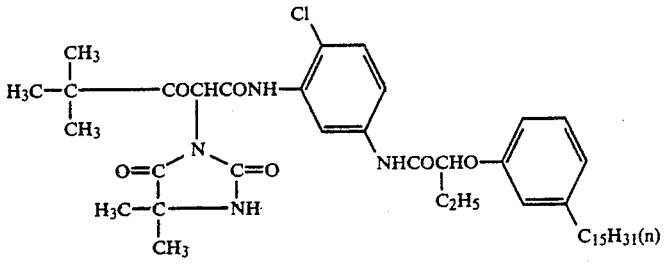
(Y-14)
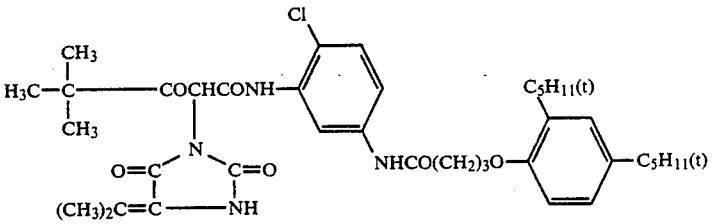
(Y-15)
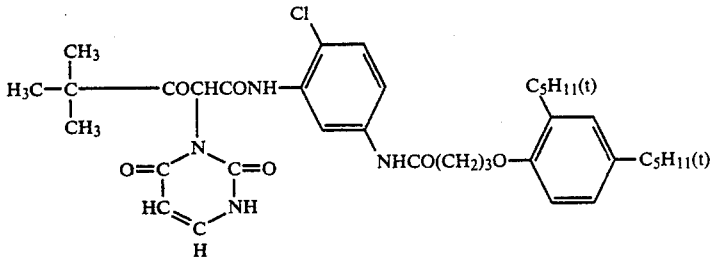

-continued
(Y-16)
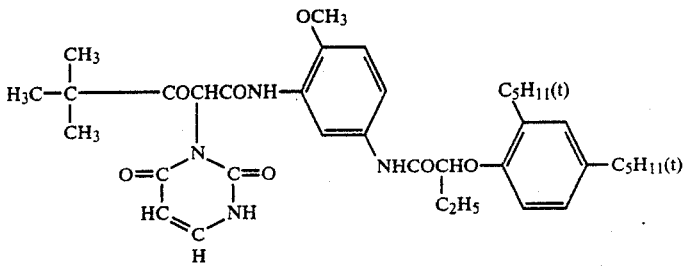
(Y-17)
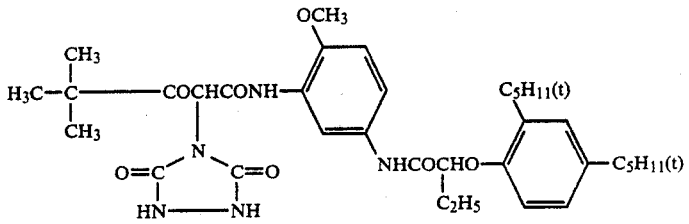
(Y-18)
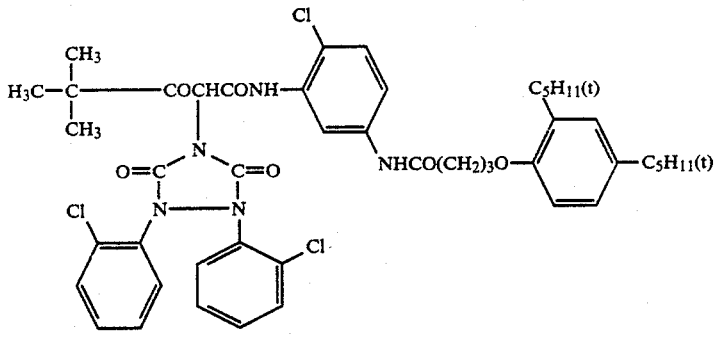
(Y-19)
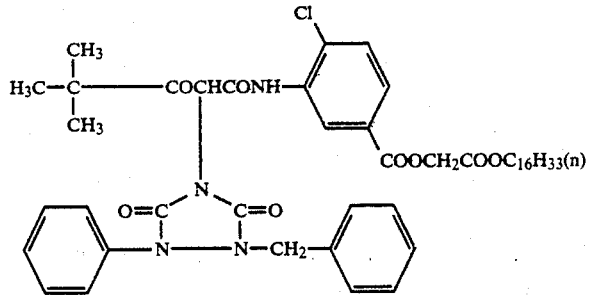
(Y-20)
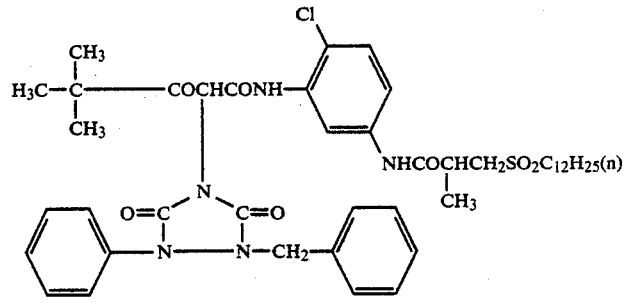

-continued
(Y-21)
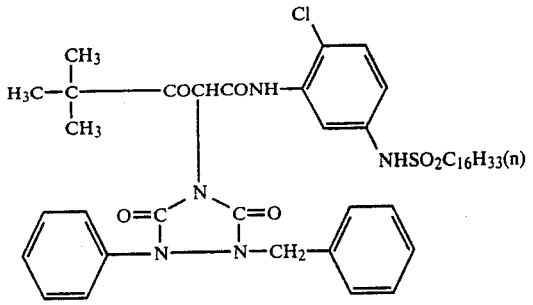
(Y-22)
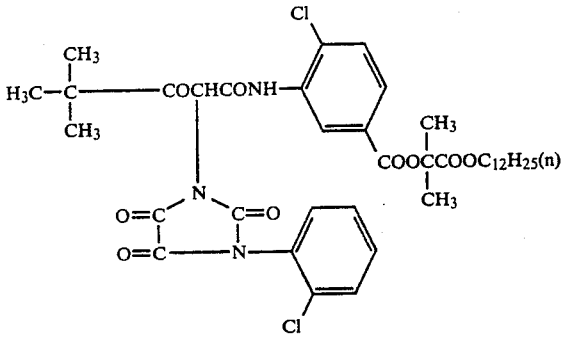
(Y-23)
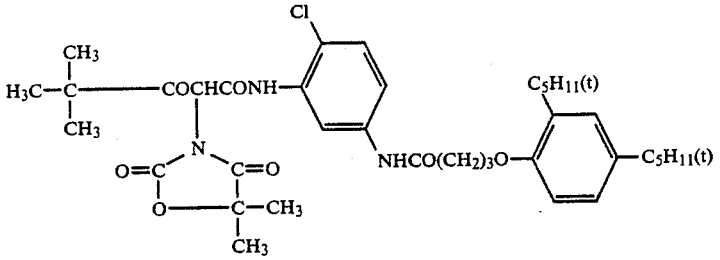
(Y-24)
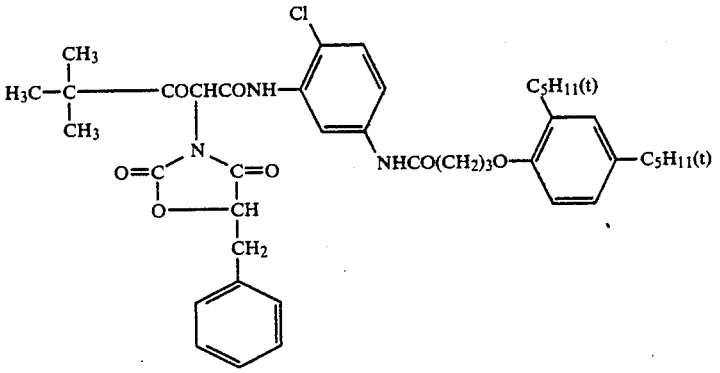
(Y-25)
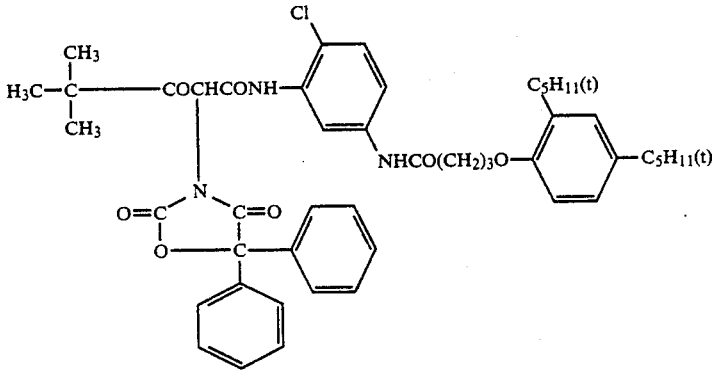

-continued
(Y-26)
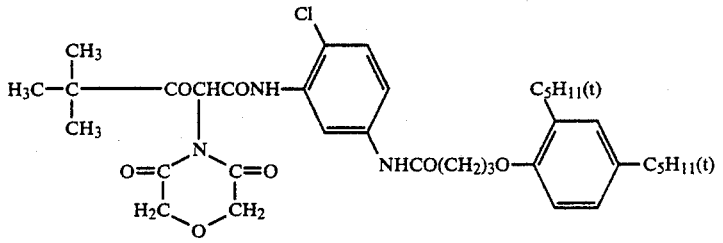
(Y-27)
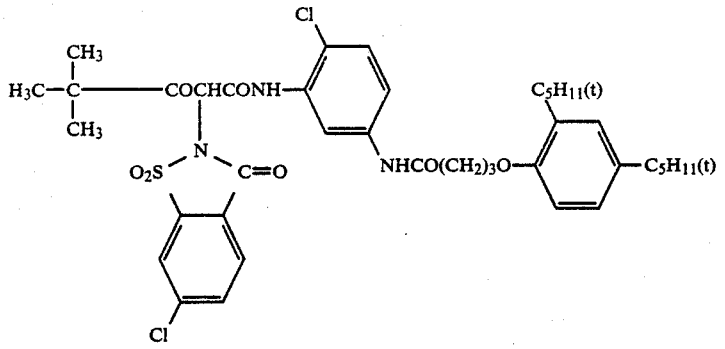
(Y-28)
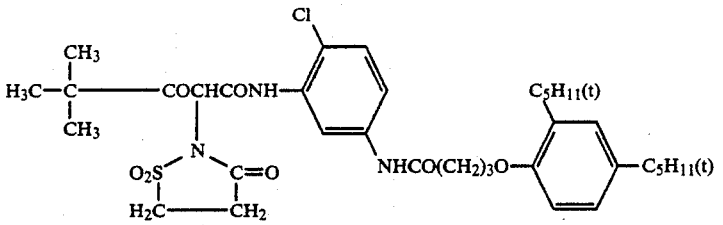
(Y-29)
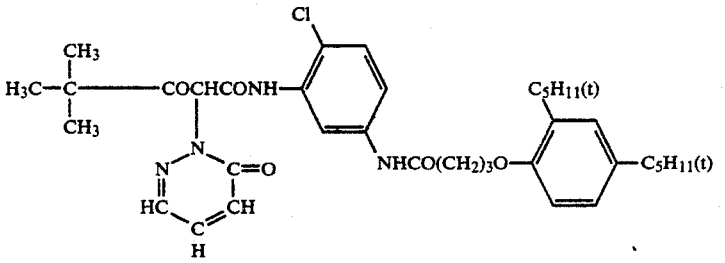
(Y-30)
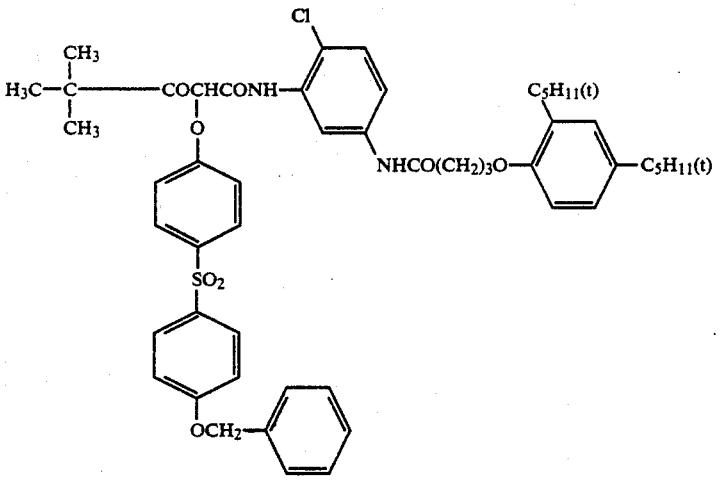

-continued (Y-31)

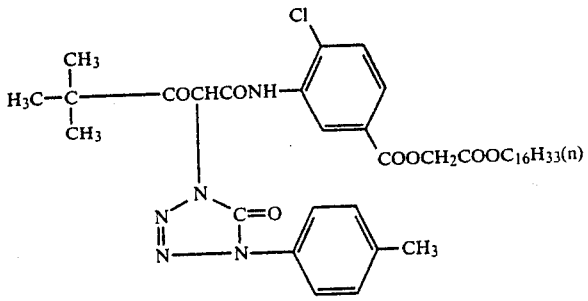

(Y-32)

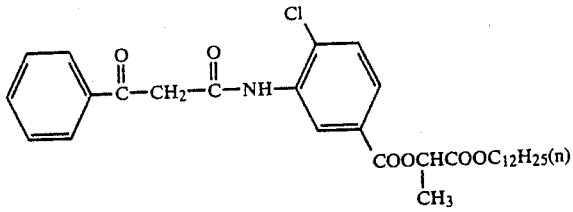

(Y-33)

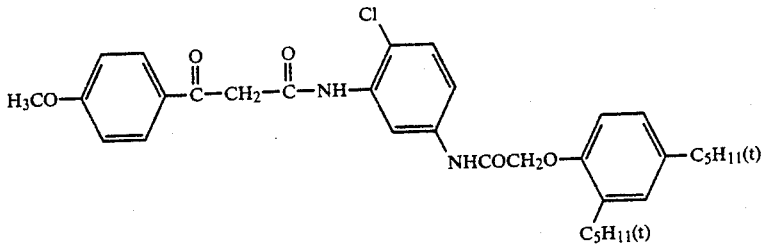

(Y-34)

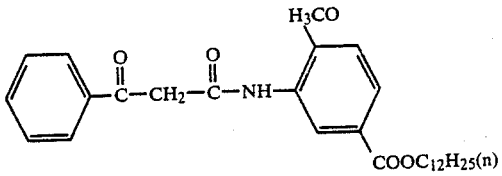

(Y-35)

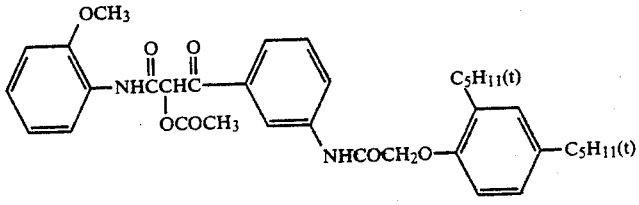

(Y-36)

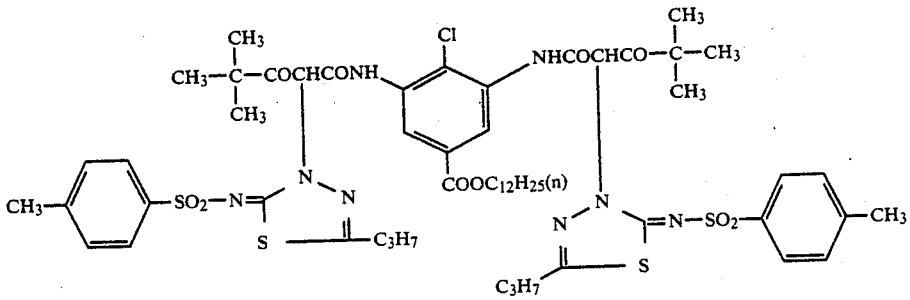

These yellow couplers can be synthesized in accordance with those methods described in, e.g., U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; West German OLS Pat. Nos. 1,547,868, 2,057,941, 2,162,899, 2,163,812, 2,213,461, 2,219,917, 2,261,361 and 2,263,875; Japanese Patent Examined Publication Nos. 13576/1974, 33410/1976 and 25733/1977; Japanese Patent O.P.I. Publication Nos. 29432/1973, 66835/1973, 94432/1973, 1229/1974, 10736/1974, 122335/1974, 28834/1975, 65231/1975 and 132926/1975; and the like.

The yellow couplers of the present invention may be used either singly or in combination of not less than two thereof. The adding quantity of these couplers is usually preferably from 0.05 mole to two moles per mole of silver halide, and particularly preferably from 0.1 to mole to 1 mole per mole of silver halide.

In the high-boiling organic solvent having Formula (II) of the present invention (hereinafter referred to as the high-boiling organic solvent of the invention), each of the $R_3$ and $R_4$ of Formula (II) is an alkyl radical selected from the group consisting of nonyl, decyl and undecyl radicals, and may be either the same or different, but is desirable to be the same, and particularly the $R_3$ and $R_4$ each is desirable to be nonyl radical. Further, the foregoing alkyl radicals represented by the $R_3$ and $R_4$ may be favorably used in any of the cyclic, straight-chain or branched-chain form, but at least either one of the $R_3$ and $R_4$ is desirable to be a branched-chain alkyl radical, and it is particularly desirable that both $R_3$ and $R_4$ are the same branched-chain radical.

The following are examples of the suitably-usable high-boiling organic solvents of the present invention, but the high-boiling organic solvents of the present invention are not limited thereto:

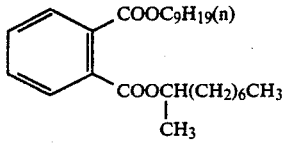
(H-1)

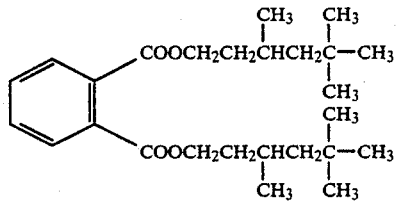
(H-2)

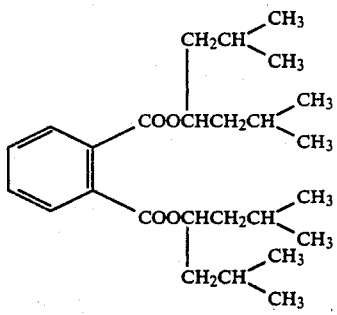
(H-3)

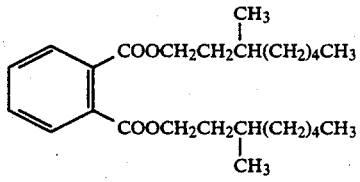
(H-4)

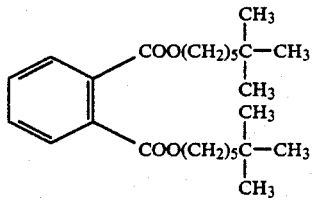
(H-5)

-continued

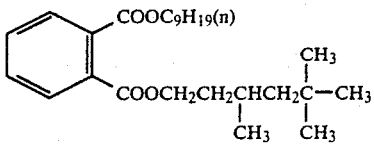
(H-6)

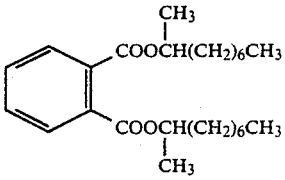
(H-7)

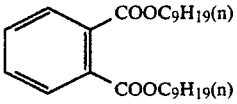
(H-8)

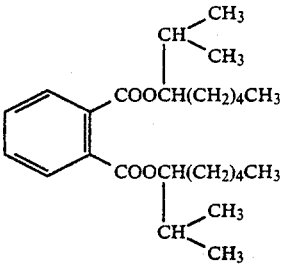
(H-9)

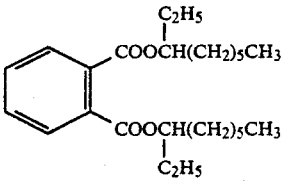
(H-10)

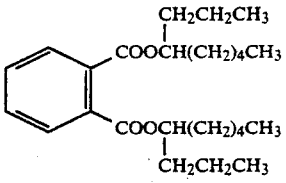
(H-11)

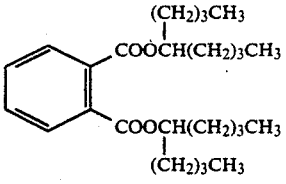
(H-12)

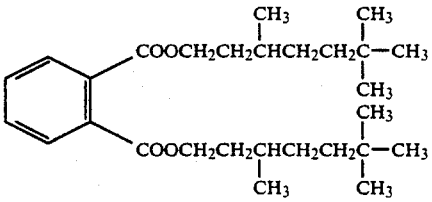
(H-13)

-continued (H-14)

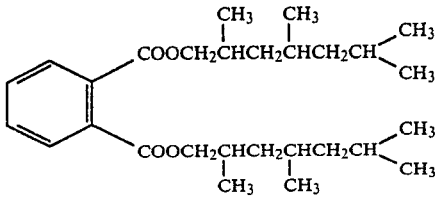

(H-15)

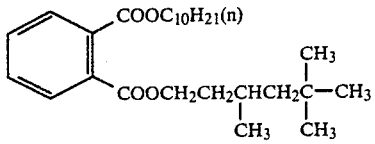

(H-16)

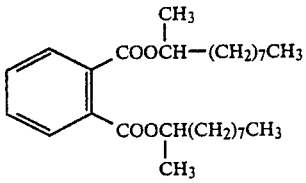

(H-17)

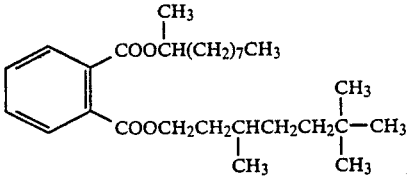

(H-18)

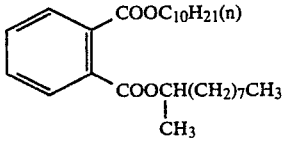

(H-19)

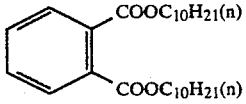

(H-20)

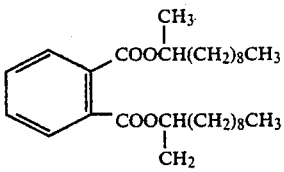

(H-21)

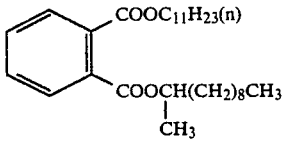

(H-22)

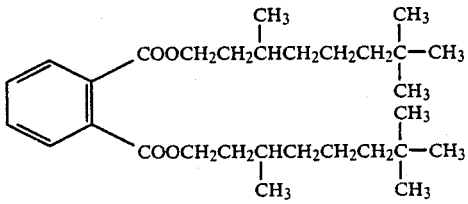

-continued (H-23)

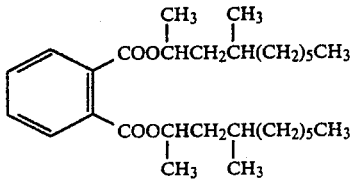

(H-24)

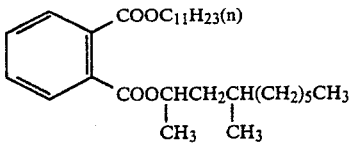

(H-25)

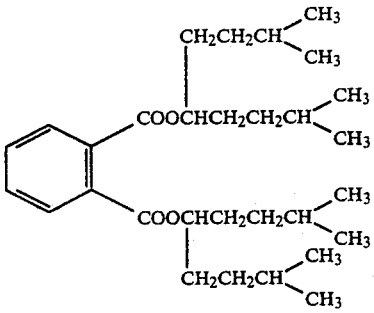

(H-26)

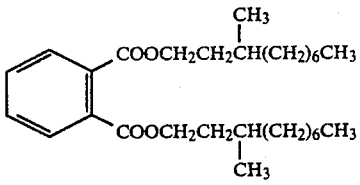

(H-27)

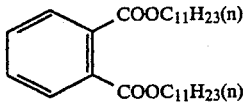

Any of the high-boiling organic solvents of the present invention can be synthesized by those methods of the prior art; for example, by the reaction of phthalic anhydride with an alcohol having alkyl chains corresponding to the $R_3$ and $R_4$ of the high-boiling organic solvent of the present invention in the presence of such an acid catalyst as sulfuric acid, or by the reaction of phthalic acid with a halogenated alkyl in the presence of a tertiary amine.

Those compounds similar to the high-boiling organic solvent of the present invention are already known to those skilled in the art. For example, U.S. Pat. No. 4,146,393 and Japanese Patent O.P.I. Publication No. 4125/1979 disclose only the use of dinonyl phthalate as an application example of the high-boiling organic solvent for cyan couplers and ultraviolet absorbing agents.

Japanese Patent O.P.I. Publication No. 91325/1979 describes a method for preventing possible yellow stain on the white area or margin of photographic prints by reducing the amount of the residual color developing agent remaining in a processed light-sensitive material by incorporating a phthalate compound thereinto, but does not refer at all to any functional effect of the present invention upon the improvement effect on the resistance to light by the use in combination of the high-boiling organic solvent of the present invention and the yellow coupler of the present invention.

The present invention provides an unexpectedly surprising light resistance-improving effect to a photographic light-sensitive material by the use in combination of the yellow coupler having Formula (I) and the high-boiling organic solvent having Formula (II), thus accomplishing the aforesaid objects of the present invention.

The adding quantity of the high-boiling organic solvent of the present invention depends on the kind of the yellow coupler of the present invention used, and, although no special resprictions are to be placed thereon, is preferably 0.1–300% by weight, and more preferably 10–70% by weight to the weight of the yellow coupler of the present invention. These high-boiling organic solvents of the present invention may be used singly or in combination of not less than two thereof, or may also be used together with some of other high-boiling organic solvents arbitrarily selected from the group of conventionally known high-boiling organic solvents such as, e.g., dibutyl phthalate, tricresyl phosphate, di-n-octyl phthalate, di-n-dodecyl phthalate, di-2-ethylhexyl phthalate, dimethyl phthalate, trihexyl phosphate, tri-2-ethylhexyl phosphate, triisononyl phosphate, dibenzyl phthalate, N,N-diethyllaurylamide, 3-pentadecylphenylethyl-ether, 2,5-di-sec-amylphenylbutyl-ether, and the like.

For the purpose of preventing possible occurrence of stain or color fog on the photographic light-sensitive material, it is desirable to use a hydroquinone derivative together with the yellow coupler of the present invention and the high-boiling organic solvent of the present invention. Typical examples of the above hydroquinone derivative are as given below:

HQ-1: 2,5-di-t-octyl-hydroquinone.
HQ-2: 2-t-octyl-5-methyl-hydroquinone.
HQ-3: 2,5-di-n-dodecyl-hydroquinone.
HQ-4: 2-n-dodecyl-hydroquinone.
HQ-5: 2,2'-methylenebis-5,5'-di-t-butyl-hydroquinone.
HQ-6: 2,5-di-n-octyl-hydroquinone.
HQ-7: 2-dodecylcarbamoylmethyl-hydroquinone.
HQ-8: 2-(β-n-dodecyloxycarbonyl)ethyl-hydroquinone.
HQ-9: 2-(N,N-dibutylcarbamoyl)hydroquinone.
HQ-10: 2-n-dodecyl-5-chlorohydroquinone.
HQ-11: 2-octadecyl-5-methyl-hydroquinone.
HQ-12: 2,5-di-(p-methoxyphenyl)hydroquinone.
HQ-13: 2-t-octyl-hydroquinone.
HQ-14: 2,5-dichloro-3,6-diphenyl-hydroquinone.
HQ-15: 2,6-dimethyl-3-t-octyl-hydroquinone.
HQ-16: 2,3-dimethyl-5-t-octyl-hydroquinone.
HQ-17: 2-{β-(dodecanoyloxy)ethyl}carbamoyl-hydroquinone.
HQ-18: 2-dodecyloxycarbonyl-hydroquinone.
HQ-19: 2-{β-(4-octaneamidophenyl)ethyl}hydroquinone.
HQ-20: 2,5-bis(1',1'-dimethylbutyl)-hydroquinone.

These hydroquinone derivatives may be used singly or in combination of not less than two thereof. Any of these hydroquinone derivatives may be used usually in an adding quantity of preferably from 0.001 mole to 2 moles, and more preferably from 0.01 mole to 1 mole per mole of the cyan coupler of the present invention.

The incorporation of such an ultraviolet absorbing agent as 2-(2'-hydroxyphenyl)benzotriazole, 2-hydroxybenzophenone, a salicylic acid ester, acrylonitrile, thiazoline or a 2'-hydroxyl-1,3,5-triazine-type compound into the layer containing the yellow coupler of the present invention and/or other photographic layers is advantageous for the prevention of possible discoloration of the yellow dye due to short-wavelength active rays and the prevention of possible static marks. Above all, the ultraviolet absorbing agents suitably usable for the prevention of possible discoloration are those compounds having the following Formula (IX):

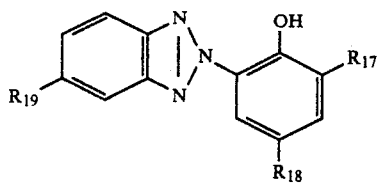

Formula (IX)

wherein $R_{17}$, $R_{18}$ and $R_{19}$ each is a hydrogen atom, a halogen atom, an alkyl radical, an aryl radical, an alkoxy radical, an aryloxy radical, an alkenyl radical, a nitro radical or a hydroxyl radical.

The following are typical examples of the ultraviolet absorbing agents having Formula (IX):

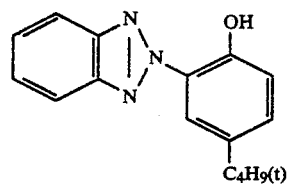

(UV-1)

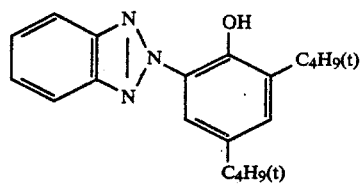

(UV-2)

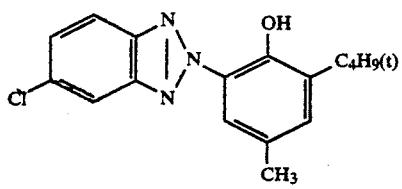

(UV-3)

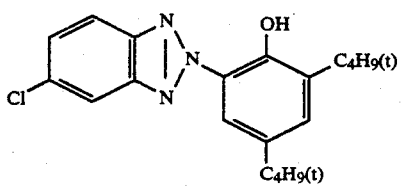

(UV-4)

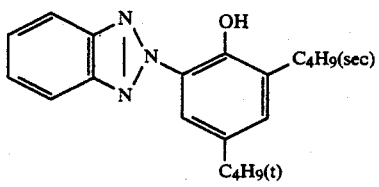

(UV-5)

-continued (UV-6)

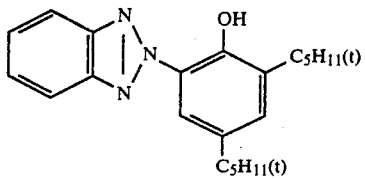

(UV-7)

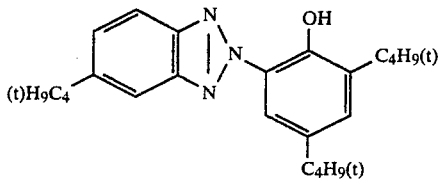

(UV-8)

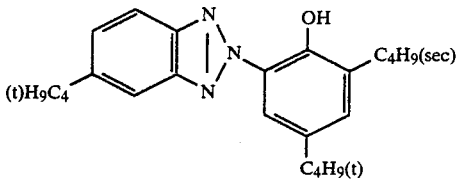

The yellow coupler of the present invention is dissolved into the high-boiling organic solvent, if necessary, combined with use of a low-boiling organic solvent as an auxiliary solvent, the solution is then finely dispersed by use of an emulsifying agent into such a dispersion medium as an aqueous gelatin solution, and the resulting emulsifiedly dispersed product is incorporated into an objective hydrophilic colloidal layer. In this instance, the yellow coupler of the present invention and the high-boiling organic solvent of the present invention are allowed to be separately emulsified to be dispersed, and after that both dispersed liquids may be mixed.

To the yellow coupler of the present invention and the high-boiling organic solvent of the present invention may be added concurrently other hydrophobic compounds (other couplers, ultraviolet absorbing agents, antidiscoloration agents, brightening agents, hydroquinone derivatives, etc.). The preferred low-boiling organic solvents usable as the auxiliary solvent include methyl acetate, ethyl acetate, propyl acetate, butyl acetate, butyl propionate, cyclohexanol, cyclohexane, tetrahydrofuran, methyl alcohol, ethyl alcohol, acetonitrile, dimethylformamide, dioxane, methyl-ethyl ketone, methyl-isobutyl ketone, diethylene-glycol monoacetate, acetylacetone, nitromethane, nitroethane, carbon tetrachloride, chloroform, and the like. The preferred emulsifying agents include anionic surfactants such as alkylbenzenesulfonic acids, alkylnaphthalene sulfonic acids, etc. and/or nonionic surfactants such a sorbitansesquioleates, sorbitanmonoluarates, etc. A dispersing apparatus there may be used simple stirrer homogenizer, colloid mill, flow-jet mixer, ultrasonic disperser, and the like. The dispersed product may be incorporated into a hydrophilic colloid, but prior to the incorporation there may be inserted a process for removing the low-boiling organic solvent.

The preferred embodiments of the dispersion of the yellow coupler of the present invention are given below:

An yellow coupler of the present invention, a high-boiling organic solvent of the present invention, a hydroquinone derivative, and ethyl acetate are mixed and dissolved by heating to 60° C. An aqueous gelatin solution as a dispersion medium is mixed with an emulsifying agent, and the mixture is heated to 60° C. Both the resulting solutions were mixed with stirring and then emulsified to be dispersed by a homogenizer or equivalent means.

For the photographic light-sensitive material of the present invention there may be used known magenta dye image-forming couplers and/or cyan dye image-forming couplers. The suitably usable couplers include those having Formulas (X) and (IX).

The preferred magenta dye image-forming couplers (hereinafter referred to as magenta couplers) have the following Formula (X):

Formula (X)

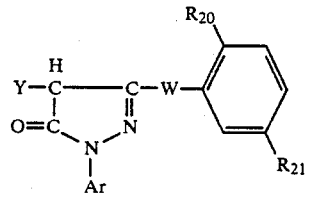

wherein Ar represents an aryl radical; $R_{20}$ is a hydrogen atom, a halogen atom, an alkyl radical or an alkoxy radical; $R_{21}$ is an alkyl radical, an amido radical, an imido radical, an N-alkylcarbamoyl radical, an N-alkylsulfamoyl radical, an alkoxycarbonyl radical, an acyloxy radical, an alkylsulfonamido radical or an urethane radical; Y is a hydrogen atom or a radical that can be split off by the reaction of the coupler with the oxidized product of an aromatic primary amine-type color developing agent; and W is an amino radical, an acylamino radical or an ureido radical.

Examples of the above magenta couplers having Formula (X) are as given below, but it goes without saying that the magenta couplers are not limited thereto:

M-1

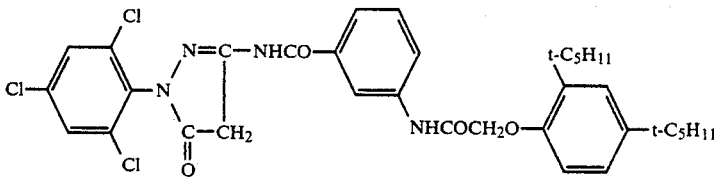

-continued
M-2
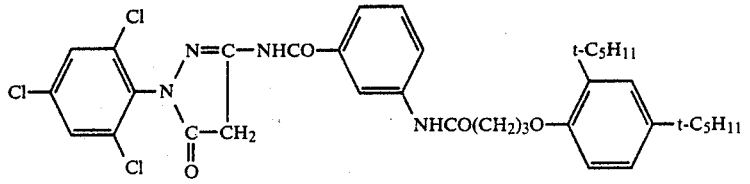
M-3
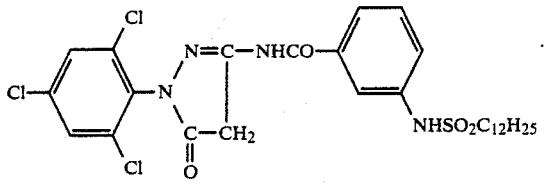
M-4
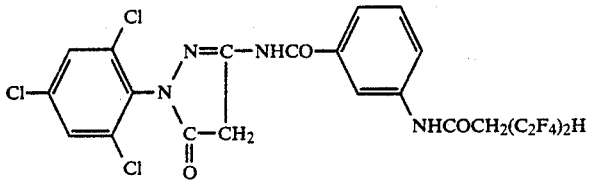
M-5
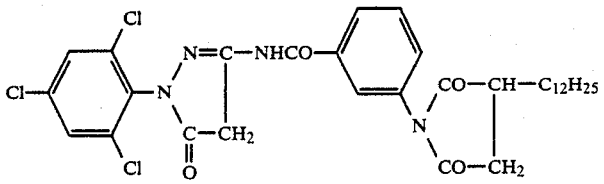
M-6
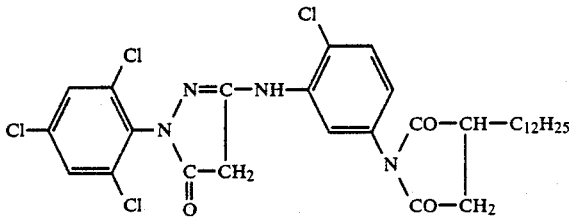
M-7
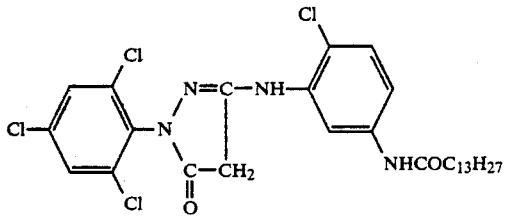
M-8
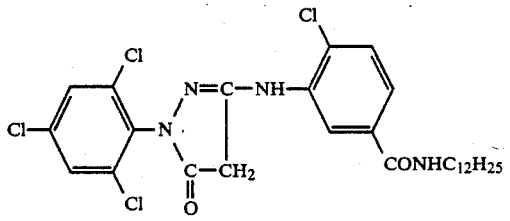
M-9
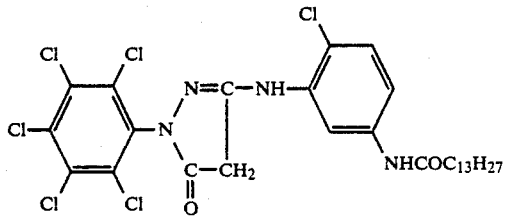

-continued

M-10

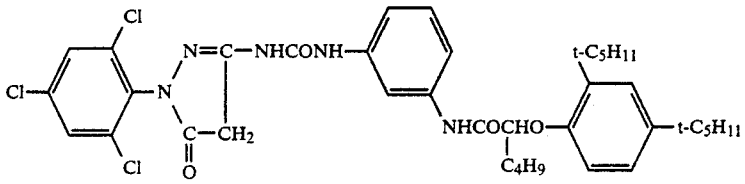

M-11

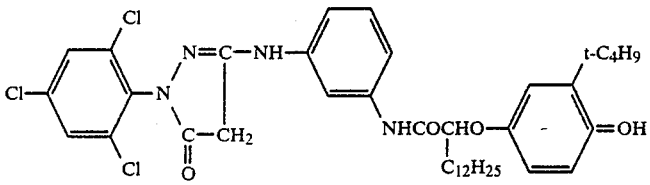

These are as described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publication Nos. 29639/1974, 111631/1974, 129538/1974, 13041/1975, 58922/1977, 62454/1980, 118034/1980, 38043/1981 and 35858/1982; British Pat. No. 1,247,493; Belgian Pat. Nos. 769,116 and 792,525; West German Pat. No. 2,156,111; and Japanese Patent Examined Publication No. 60479/1971.

The preferred cyan dye image-forming couplers (hereinafter referred to as cyan couplers) are those compounds having the following Formula (XI):

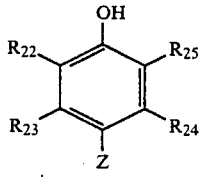

Formula (XI)

wherein Z is a hydrogen atom or a radical that can be split off by the reaction of the coupler with the oxidized product of an aromatic primary amine-type color developing agent; and $R_{22}$, $R_{23}$, $R_{24}$, and $R_{25}$ each is a hydrogen atom, a halogen atom, an alkyl radical, a carbamoyl radical, a sulfamoyl radical, an amido radical, a sulfonamido radical, a phosphoric acid amido radical or an ureido radical.

The following are typical examples of the cyan couplers having Formula (XI):

C-1

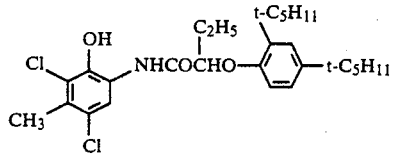

C-2

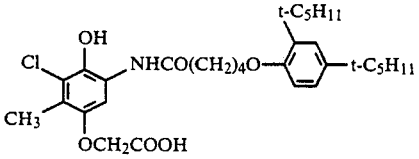

-continued

C-3

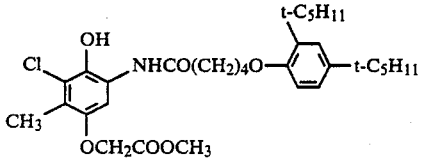

C-4

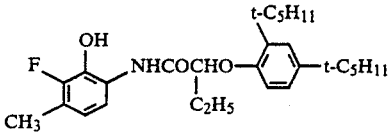

C-5

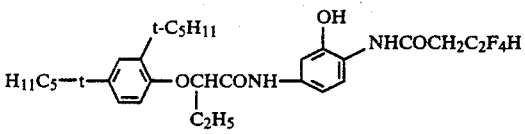

C-6

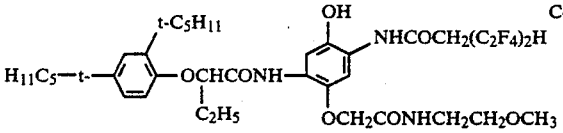

C-7

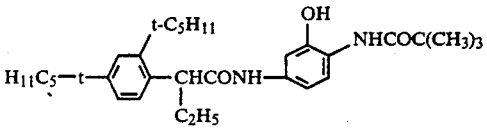

C-8

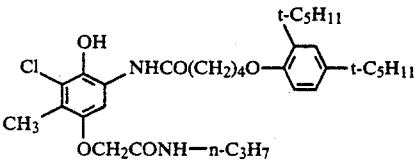

These are as described in, e.g., U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,247, 3,652,286, 3,737,326, 3,758,308, 3,779,763, 3,839,044 and 3,880,661; West German OLS Pat. Nos. 2,163,811 and 2,207,468; Japanese Patent Examined Publication Nos. 27563/1964 and 28836/1970; Japanese Patent O.P.I. Publication Nos. 37425/1972, 10135/1975, 25228/1975, 112038/1975, 117422/1975, 130441/1975, 109630/1978, 65134/1981 and 99341/1981; and Research Disclosure No. 148, p. 14,853 (1976), and the like.

The silver halide emulsion used in the photographic light-sensitive material of the present invention is generally a hydrophilic colloid containing silver halide particles dispersed thereinto. The silver halide used includes silver chloride, silver bromide, silver iodide, silver chlorobromide, silver iodobromide, silver chloroiodobromide and a mixture of these silver halides. These silver halides can be prepared by various processes such as the ammoniacal process, neutral process, the so-called conversion process, simultaneously mixing process, and the like. As the hydrophilic colloid into which is to be dispersed the silver halide, gelatin or gelatin derivatives such as phthalated gelatin, malonated gelatin, or the like, may be used, but these may also be partially or wholly replaced by albumin, agar-agar, gum arabic, alginic acid, casein, partially hydrolyzed cellulose derivatives, partially hydrolyzed polyvinyl acetate, polyacrylamide, imidated polyacrylamide, polyvinyl pyrolidone or copolymers of these vinyl compounds. Further, any of these silver halide emulsions may be spectrally sensitized by use of various sensitizing dyes in order to render it sensitive to any desired wavelength region. As the spectrally sensitizing dye for this purpose, there may be used singly or in combination cyanine dyes, merocyanine dyes or complex cyanine dyes. And, if necessary, there may also be used singly or in combination such photographic additives including, for example, chemical sensitizers including noble-metallic salts such as compounds of gold, platinum, palladium, iridium, rhodium, ruthenium, etc., sulfur compounds, reduction materials or thioether compounds, quaternary ammonium compounds or polyalkyleneoxide compounds, etc.; stabilizers such as triazoles, imidazoles, azaindenes, benzothiazoles, tin compounds, cadmium compounds, mercaptans, etc.; hardening agents such as chromium salts, zirconium salts, mucochloric acid, aldehyde-type and triazine-type polyepoxy compounds, active halogenated compounds, ketone compounds, acryloyl-type, triethylenephosamide-type and ethyleneimine-type hardeners, etc.; plasticizers of dihydroxyalkanes such as glycerol, 1,5-pentanediol, etc.; brightening agents; antistatic agents; coating aids; and the like.

Into the obtained silver halide emulsion layer is incorporated the foregoing dispersed liquid into which is dispersed the aforementioned compounds of the present invention. Further, if necessary, into the subbing layer, interlayer, yellow filter layer, ultraviolet absorbing layer, protective layer, and the like, are incorporated dispersed products of the compounds of the present invention. And these layers are coated on a support such as of cellulose acetate, nitrocellulose, polycarbonate, polyethylene terephthalate, synthetic resin film such as of polyethylene, baryta paper, polyethylene-coated paper, glass plates, or the like, thus producing a photographic light-sensitive material. These are described in detail in Research Disclosure No. 17643 (1978) and the like.

The above photographic light-sensitive material is particularly advantageous for coupler-in-emulsion-type silver halide color photographic light-sensitive materials, and, after being exposed imagewise to light, is processed by the color development process. Further, the photographic light-sensitive material may be of the type that the coupler and a color developing agent are present so as not to come into contact with each other before exposure and processing in a same layer and, after being exposed to light and processed, are able to come into contact with each other; or of such the coupler-in-emulsion-type silver halide color photographic light-sensitive material type that the coupler-free layer thereof contains a color developing agent which moves, when an alkaline processing liquid permeates into the light-sensitive material, to come into contact with the coupler.

And in that instance, the support used therefor is desirable to be any of baryta paper, polyethylene-coated paper, titanium oxide-containing polyethylene terephthalate film, electron beam-setting resin-coated paper and polypropylene-synthetic paper.

Furthermore, the photographic light-sensitive material is desirable to be of the type comprising a support, made of any one of the above support materials, having thereon in order at least a blue-sensitive emulsion layer, a green-sensitive emulsion layer and a red-sensitive emulsion layer, and, besides, at least two ultraviolet absorbing agent-containing layers provided on the further side than the foregoing green-sensitive emulsion layer from the support.

Referring to the processing of the photographic light-sensitive material of the present invention, in the reversal process, the light-sensitive material is first processed in a black-and-white developer bath, and then the entire area of the material is either exposed to a white light or processed in a bath containing such a fogging agent as a boron compound, and after that color-developed in an alkaline liquid containing a color developing agent. In this instance, the development may also be made in an alkaline developer bath containing a fogging agent together with the color developing agent. After the color development, the developed light-sensitive material is bleached in a bleaching bath containing ferricyanide or ferric carboxylate as an oxidizing agent, and then fixed in a fixing bath containing such a silver halide solvent as a thiosulfate to remove the silver image and residual silver halide, thereby leaving the formed dye image. Instead of using the bleaching bath and the fixing bath, a bleach-fix monobath may be used for bleaching and fixing the material, the monobath containing ferric aminopolycarboxylate as an oxidizing agent and a thiosulfate as a silver halide solvent. In combination with the color development, bleaching, fixing, or bleach-fixing, there may also take place such processings or prehardening, neutralizing, washing, stop, stabilizing, and the like. Particularly, the processings by which the photographic light-sensitive material of the present invention is advantageously processed are, e.g., color development, if necessary, bleach-fixing, washing, if necessary, stabilizing, and drying, and these processings take place in a very short period of time at as high a temperature as not less than 30° C.

The color developer, as previously described, contains a color developing agent and certain necessary additives whose typical examples include, e.g., alkali agents such as hydroxides, carbonates, phosphates, etc., of an alkali metal or of ammonium, buffer such as acetic acid, boric acid, etc., pH control agent, a development accelerator, antifoggant, antistain agent, antisludge agent, interlayer effect accelerator, preservative, and the like.

The bleaching agent for use in the bleaching includes ferricyanides such as potassium ferricyanide, bichromates, permanganates, hydrogen peroxide, chloride of lime; metallic complex salts of such aminopolycarboxylic acids as ethylenediaminetetraacetic acid, iminodiacetic acid, and the like; metallic complex salts of such polycarboxylic acids as malonic acid, tartaric acid, malic acid, and the like; ferric chloride; and the like. These may be used singly or in combination at need. To the bleach-fix bath may be added, if necessary, various additives including a bleach accelerator and the like.

The fixing agent for use in the fixing process includes thiosulfates such as sodium thiosulfate, ammonium thiosulfate, etc., cyanides and urea derivatives. To the fixing bath may be added, if necessary, various additives including a fixing accelerator and the like.

The photographic light-sensitive material of the present invention may be effectively processed also by use of a color developer solution containing both an aromatic primary amine-type color developing agent and an oxidizing agent that causes the metallic silver image to take part in a redox reaction.

When such a color developer liquid is used, the color developing agent is oxidized by the oxidizing agent, and then effects a coupling reaction with photographic couplers to thereby form a dye image. Such the color developer liquid is disclosed in, e.g., Japanese Patent O.P.I. Publication No. 9729/1973. The preferred oxidizing agents for this purpose are cobalt complex salts whose coordination number is 6. The color photographic development process including such the color developer liquid is particularly useful for silver-saving-type photographic light-sensitive materials containing a smaller amount of silver than that of ordinary photographic light-sensitive materials.

The photographic light-sensitive material of the present invention is developed in a color developer bath containing an aromatic primary amine-type color developing agent, and may also be subsequently processed preferably in an amplifying bath containing the foregoing oxidizing agent such as, e.g., a cobalt complex salt whose coordination number is six, in which the color developing agent which has been permeated into the light-sensitive layer during the preceding developing process and which is movable into the amplifying bath and, if necessary, a color developing agent in advance being present in the amplifying bath come into contact with the cobalt complex salt. In addition, another oxidizing agent suitably usable for this purpose is an aqueous hydrogen peroxide solution.

The present invention is illustrated further in detail in reference to examples below, but the embodiments of the present invention are not limited thereto

EXAMPLE 1

Samples were prepared which have the construction as given in Table 1.

TABLE 1

| | | Coated q'ty of silver | Coated q'ty of gelatin | Coupler-dispersed liquid |
|---|---|---|---|---|
| Layer 2 | Protective layer | — | 20 | — |
| Layer 1 | Blue-sensitive EM layer | 4.0 | 25 | (Table 2) |
| Polyethylene-coated paper support | | | | |

*Coated quantity unit: in mg/100 cm$^2$

The respective samples were prepared using the blue-sensitive emulsion layer's coupler dispersion compositions varied as given in Table 2. The coating quantity of the coupler is 10 mg/100 cm$^2$. The yellow coupler dispersion liquids each was prepared in the following procedures (a) to (b):

(a) Thirty-one grams of Exemplified Yellow Coupler Y-7 of the present invention, 0.6 g of 2,5-di-t-octylhydroquinone (HQ-1), 22 g of the high boiling organic solvent given in Table 2, and 62 g of ethyl acetate were mixed and dissolved by heating to 60° C.

(b) Forty grams of photographic gelatin and 500 ml of pure water were mixed at room temperature and swelled spending about 20 minutes, and then dissolved by heating to 60° C. After that to this were added 50 ml of an aqueous 5% Alkanol B (produced by DuPont) solution, and the mixture was stirred until it becomes homogeneous.

(c) The respective solutions obtained in (a) and (b) were mixed and dispersed by means of an ultrasonic disperser for a period of 30 minutes, whereby a dispersed liquid was obtained.

TABLE 2

| Sample No. | Exemplified coupler and quantity (g) | Hydroquinone derivative & quantity (g) | Hi-boiling organic solvent & quantity (g) | Low-boiling organic solvent & q'ty (g) | |
|---|---|---|---|---|---|
| 1 | (Y-7) 31 | (HQ-1) 0.6 | DBP 22 | EA 62 | Comparative |
| 2 | " | " | DOP 22 | " | " |
| 3 | " | " | (H-8) 22 | " | Invention |
| 4 | " | " | (H-2) 22 | " | " |
| 5 | " | " | (H-19) 22 | " | " |
| 6 | " | " | (H-12) 22 | " | " |
| 7 | " | " | (H-27) 22 | " | " |
| 8 | " | " | (H-21) 22 | " | " |
| 9 | " | " | DLP 22 | " | Comparative |

In Table 2, DBP stands for di-n-butyl phthalate, DOP for di-2-ethylhexyl phthalate, DLP for di-n-lauryl phthalate, and EA for ethyl acetate.

The thus obtained nine samples were subjected to the following tests (1) to (3):

(1) Coupler's dispersion stability tests

Measurements were made on the turbidities (correlating with the dispersed particles; the smaller the value, the smaller the particle size) of the respective dispersed liquids obtained in the above procedures (a) to (c), and the particle's deposition degrees (deposition starting points of time). The measurements took place after allowing the samples to stand without stirring at 40° C. for 10 hours.

(2) Sensitometry tests

The nine coated samples each was exposed through an optical wedge to light by use of a sensitometer (Model KS-7, manufactured by Konishiroku Photo Industry Co., Ltd.) and then processed in the following processing liquids in accordance with the steps below:

| Processing steps | Time | Temperature |
|---|---|---|
| Color developing | 3.5 minutes | 33° C. |
| Bleach-fix | 1.5 minutes | 33° C. |
| Washing | 3.0 minutes | 33° C. |
| Drying | — | 80° C. |

Color developer composition

| | |
|---|---|
| Pure water | 700 ml |
| Benzyl alcohol | 15 ml |
| Diethylene glycol | 15 ml |
| Hydroxyamine sulfate | 2 g |
| N—ethyl-N—β-methanesulfoneamidoethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Pure water to make 1 liter (pH = 10.2) | |

Bleach-fix bath composition

| | |
|---|---|
| Iron-ammonium ethylenediaminetetraacetate | 61 g |
| Diammonium ethylenediaminetetraacetate | 5 g |
| Ammonium thiosulfate | 125 g |
| Sodium metabisulfite | 13 g |
| Sodium sulfite | 2.7 g |
| Water to make 1 liter (pH = 7.2) | |

The thus processed samples each was measured with respect to the relative speed and the maximum reflection density by use of a photoelectric densitometer (Model PDA-60, manufactured by Konishiroku Photo Industry Co., Ltd.). The obtained results are as shown in Table 3.

(3) Dye image preservability tests

Each of the nine samples processed in the same way as in (2) was subjected to dye image preservability tests in the following procedures (a) and (b):

(a) Light-discoloration characteristic

| | Illuminance (Lux) | Irradiation period (hr) |
|---|---|---|
| A Xenon fadeometer | $3.5 \times 10^4$ | 100 |
| B Fluorescent lamp fadeometer | $1.6 \times 10^4$ | 300 |

(b) Dark-discoloration characteristic

The samples were aged under the following conditions:

| | | |
|---|---|---|
| C At 77° C. | without humidification | for 14 days |
| D At 70° C. | 80% RH (relative humidity) | for 14 days |

In addition, the results of the dye image preservability tests are given in Table 3 in percentage (%) of the after-test density (D) to the initial density (Do)=1.0.

All the results obtained in (1) to (3) are as given in Table 3.

TABLE 3

| Sample No. | High boiling organic solvent | Turbidity: Right after dispersion | Turbidity: After ten hours | Turbidity: Difference | Deposition starting time (hr) | Sensitometric characteristics: Relative speed | Sensitometric characteristics: Max reflection density | Sensitometric characteristics: Gamma (γ) | Light discoloration A | Light discoloration B | Dark discoloration C | Dark discoloration D | |
|---|---|---|---|---|---|---|---|---|---|---|---|---|---|
| 1 | DBP | 28.0 | 57.2 | 29.2 | 7.5 | 100 | 2.42 | 3.32 | 51 | 72 | 96 | 92 | Comparative |
| 2 | DOP | 28.3 | 45.4 | 17.1 | 8.0 | 93 | 2.31 | 3.11 | 55 | 75 | 97 | 93 | " |
| 3 | (H-8) | 28.2 | 44.7 | 16.5 | Not less than 10 | 98 | 2.36 | 3.05 | 64 | 81 | 97 | 93 | Invention |
| 4 | (H-2) | 28.4 | 34.3 | 5.9 | Not less than 10 | 99 | 2.43 | 3.31 | 73 | 86 | 97 | 94 | " |
| 5 | (H-19) | 29.5 | 46.4 | 16.9 | Not less than 10 | 98 | 2.35 | 3.03 | 63 | 80 | 96 | 93 | " |
| 6 | (H-12) | 29.1 | 36.2 | 7.1 | Not less than 10 | 99 | 2.42 | 3.33 | 70 | 85 | 98 | 93 | " |
| 7 | (H-27) | 28.6 | 48.3 | 19.7 | Not less than 10 | 98 | 2.38 | 3.08 | 64 | 80 | 96 | 92 | " |
| 8 | (H-21) | 28.1 | 35.6 | 7.5 | Not less than 10 | 101 | 2.41 | 3.32 | 72 | 85 | 97 | 93 | " |
| 9 | DLP | 28.9 | 49.5 | 20.6 | Not less than 10 | 92 | 2.28 | 3.03 | 56 | 77 | 95 | 92 | Comparative |

As apparent from Table 3, the samples for the present invention (Samples 3 to 8) are excellent in the sensitometric characteristics as well as in the light-discoloration and dark-discoloration characteristics, and particularly remarkably improved on the light-discoloration characteristic.

Of these samples for the present invention, Samples 4, 6 and 8 which use the branched-chain alkyl-having high-boiling organic solvents of the present invention show better improved light-discoloration characteristic, and also improved so that increase in the turbidity after a passage of time is repressed, thus showing much improved dispersion stability.

EXAMPLE 2

Similar samples were prepared in the same manner as in Example 1 with the exception that DBP and Exemplified Compound (H-2) of the present invention as high-boiling organic solvents and those couplers as shown in Table 4 were used. These samples were subjected to the same dye image preservability tests as in Example 1. The obtained results are as given in Table 5.

TABLE 4

| | Coupler | High-boiling organic solvent | |
|---|---|---|---|
| 1A | (Y-7) | DBP | Comparative |
| 1B | | (H-2) | Invention |
| 2A | (Y-21) | DBP | Comparative |
| 2B | | (H-2) | Invention |
| 3A | (Y-23) | DBP | Comparative |
| 3B | | (H-2) | Invention |
| 4A | (Y-30) | DBP | Comparative |
| 4B | | (H-2) | Invention |
| 5A | (Y-35) | DBP | Comparative |
| 5B | | (H-2) | Invention |
| 6A | Comparative | DBP | Comparative |
| 6B | coupler-1 | (H-2) | " |
| 7A | Comparative | DBP | " |
| 7B | coupler-2 | (H-2) | " |

Comparative Coupler-1 and Comparative Coupler-2 in the above table are given below:

Comparative Coupler-1

The magenta coupler described in U.S. Pat. No. 3,684,514

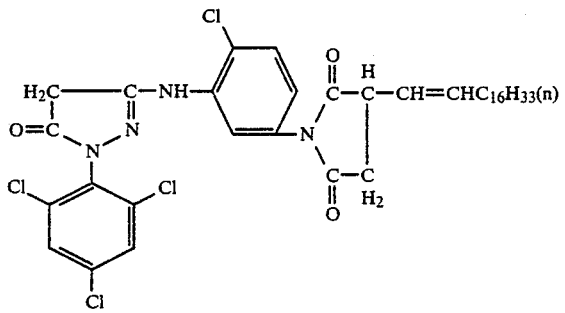

Comparative Coupler-2

The cyan coupler described in U.S. Pat. No. 2,423,730

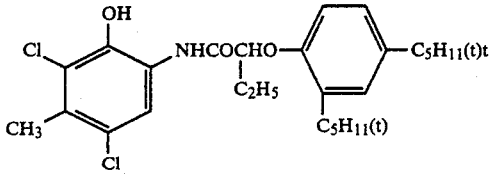

TABLE 5

| | Light discoloration | | Dark discoloration | | |
|---|---|---|---|---|---|
| | A | B | A | B | |
| 1A | 51 | 72 | 96 | 92 | Comparative |
| 1B | 73 | 86 | 97 | 94 | Invention |
| 2A | 46 | 68 | 96 | 93 | Comparative |
| 2B | 70 | 82 | 97 | 94 | Invention |
| 3A | 40 | 61 | 96 | 92 | Comparative |
| 3B | 68 | 77 | 96 | 93 | Invention |
| 4A | 52 | 72 | 96 | 93 | Comparative |
| 4B | 75 | 88 | 97 | 94 | Invention |
| 5A | 43 | 64 | 95 | 90 | Comparative |
| 5B | 56 | 71 | 95 | 91 | Invention |
| 6A | 37 | 52 | 95 | 91 | Comparative |
| 6B | 38 | 53 | 95 | 92 | " |
| 7A | 80 | 93 | 65 | 71 | " |
| 7B | 80 | 94 | 67 | 72 | " |

As apparent from Table 5, only the samples using the yellow couplers of the present invention are largely improved on the light-resistant effect. Particularly this effect is conspicuous in the case where the yellow coupler having Formula (VII) is used.

EXAMPLE 3

A sample was prepared which has the layer construction as given in Table 6. This was regarded as Sample 1.

TABLE 6

| Layer No. | Layer | Coated q'ty of silver | Coated q'ty of gelatin | Coated q'ty of UV absorbent | Coated q'ty of coupler | High-boiling solvent |
|---|---|---|---|---|---|---|
| Layer 7 | Protective layer | — | 7 | — | — | — |
| Layer 6 | Third interlayer | — | 10 | 4.0 | — | DOP 3.0 |
| Layer 5 | Red-sensitive EM layer | 3.0 | 15 | — | Comparative coupler-2 6.0 | DOP 3.0 |
| Layer 4 | Second interlayer | — | 15 | 8.0 | — | DOP 6.0 |
| Layer 3 | Green-sensitive EM layer | 3.0 | 15 | — | Comparative coupler-1 6.1 | TCP 5.0 |
| Layer 2 | First interlayer | — | 7 | — | — | DOP 0.5 |
| Layer 1 | Blue-sensitive EM layer | 4.0 | 15 | — | (Y-7) 10.0 | DBP 6.0 |
| | Polyethylene-coated paper support | | | | | |

Note:
*In the above table, TCP stands for tricresyl phosphate.
*DOP stands for di-2-ethylhexyl phthalate.
*Coated q'ty stands for coated quantity: mg/cm$^2$ Sample 2 was prepared in the same manner as in Sample 1 with the exception that the DBP of Layer 1 given in Table 6 was replaced by the high-boiling organic solvent (H-2) of the present invention.

The obtained samples each was exposed in the same way as in Example 1 but to a blue light alone. The obtained yellow color formed samples were subjected to dye image preservability tests under the same conditions as previously described. The results are as given in Table 7.

TABLE 7

| Sample | Light discoloration A | Light discoloration B | Dark discoloration C | Dark discoloration D |
|---|---|---|---|---|
| 1 (Comparative) | 63 | 65 | 96 | 92 |
| 2 (Invention) | 78 | 85 | 97 | 93 |

From Table 7, it is apparent that also in the case of the multilayered samples using an ultraviolet absorbing agent, the sample for the present invention has still largely improved effect on both light-discoloration and dark-discoloration characteristics.

What is claimed is:

1. A silver halide photographic light-sensitive material comprising a support having thereon at least one silver halide emulsion layer, said silver halide emulsion layer containing in combination at least one yellow dye image-forming coupler having the following Formula (I) and at least one high-boiling organic solvent having the following Formula (II):

Formula (I)

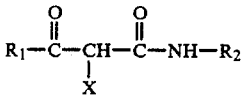

wherein $R_1$ is an alkyl radical or an aryl radical; $R_2$ is an aryl radical; and X is a radical that can be split off by the reaction with the oxidized product of an aromatic primary amine-type color developing agent, wherein said radical represented by X is a radical selected from the group consisting of Formula (IV), (V), and or (VI):

$-O-R_5$ Formula (IV)

wherein $R_5$ is an aryl radical, a heterocyclic radical or an acyl radical, or

Formula (V)

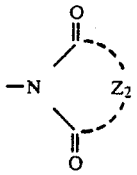

wherein $Z_2$ is a group of nonmetallic atoms capable of forming a 4- to 6-member ring together with Formula (VI)

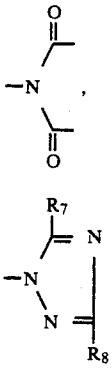

wherein $R_7$ and $R_8$ each is a hydrogen atom, a halogen atom, an alkyl radical, an alkenyl radical, an alkoxy radical, an aryl radical, a carboxy radical, an alkoxycarbonyl radical, a carbamyl radical, a sulfone radical, a sulfamyl radical, a sulfonamido radical, an acylamido radical, an ureido radical or an amino radical;

Formula (II)

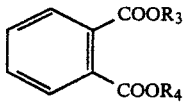

wherein $R_3$ and $R_4$ each is an alkyl radical selected from the group consisting of nonyl radical, decyl radical and undecyl radical, said $R_3$ and $R_4$ being either the same or different.

2. The silver halide photographic light-sensitive material of claim 1, wherein said alkyl radical represented by said $R_1$ of Formula (I) is a pivalyl radical, and said aryl radical represented by said $R_2$ is a phenyl radical.

3. The silver halide photographic light-sensitive material of claim 1, wherein said yellow dye image-forming coupler having Formula (I) is a compound having the following Formula (VII):

Formula (VII)

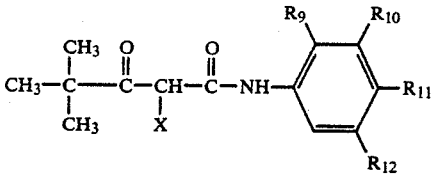

wherein $R_9$ is a hydrogen atom, a halogen atom, or an alkoxy radical; $R_{10}$, $R_{11}$ and $R_{12}$ each is a hydrogen atom, a halogen atom, an alkyl radical, an alkenyl radical, an alkoxy radical, an aryl radical, a carboxyl radical, an alkoxycarbonyl radical, a carbamyl radical, a sulfone radical, a sulfamyl radical, an alkylsulfonamido radical, an acylamido radical, an ureido radical or an amino radical; and X is as defined in Formula (I).

4. The silver halide photographic light-sensitive material of claim 3, wherein said $R_9$ of Formula (VII) is a halogen atom; said $R_{10}$ and $R_{11}$ each is a hydrogen atom; said $R_{12}$ is an alkoxycarbonyl radical, an acylamido radical or an alkylsulfonamido radical; and said X is a radical having Formula (V), (VI), or (IV).

5. The silver halide photographic light-sensitive material of claim 4, wherein said radical represented by said X in Formula (VII) is a radical having Formula (V) or (VI).

6. The silver halide photographic light-sensitive material of claim 1, wherein said yellow dye image-forming coupler having Formula (I) is a compound having Formula (VIII):

Formula (VIII)

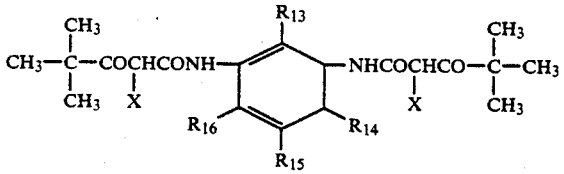

wherein $R_{13}$ is the same radical as defined in said $R_9$ of Formula (VII); $R_{14}$, $R_{15}$ and $R_{16}$ each is a hydrogen atom, a halogen atom, an alkyl radical, an alkenyl radical, an alkoxy radical, an aryl radical, carboxyl radical, an alkoxycarbonyl radical, a carbamyl radical, a sulfone radical, a sulfamyl radical, a sulfonamido radical, an acylamido radical, an ureido radical or an amino radical; and X is as defined in Formula (I).

7. The silver halide photographic light-sensitive material of claim 6, wherein said radical represented by said X of Formula (VIII) is a radical having Formula (V) or (VI).

8. The silver halide photographic light-sensitive material of claim 1, wherein said alkyl radicals represented by said $R_3$ and $R_4$ of Formula (II) are the same alkyl radicals.

9. The silver halide photographic light-sensitive material of claim 8, wherein said alkyl radicals represented by said $R_3$ and $R_4$ of Formula (II) are each nonyl radical.

10. The silver halide photographic light-sensitive material of claim 1 or 9, wherein at least one of said alkyl radicals represented by said $R_3$ and $R_4$ of Formula (II) is a branched-chain alkyl radical.

11. The silver halide photographic light-sensitive material of claim 1 or 9, wherein said alkyl radicals represented by said $R_3$ and $R_4$ of Formula (II) are alkyl radicals in the same branched-chain form.

12. The silver halide photographic light-sensitive material of claim 1, wherein said yellow dye image-forming coupler having Formula (I) is contained in said silver halide emulsion layer within the quantity range of from 0.05 mole to 2 moles per mole of silver halide.

13. The silver halide photographic light-sensitive material of claim 12, wherein said yellow dye image-forming coupler having Formula (I) is contained in said silver halide emulsion layer within the quantity range of from 0.1 mole to 1 mole per mole of silver halide.

14. The silver halide photographic light-sensitive material of claim 1, wherein said high-boiling organic solvent having Formula (II) is contained in said silver halide emulsion layer within the quantity range of from 0.1% by weight to 300% by weight to the weight of said yellow dye image-forming coupler having Formula (I).

15. The silver halide photographic light-sensitive material of claim 14, wherein said high-boiling organic solvent having Formula (II) is contained in said silver halide emulsion layer within the quantity range of from 10% by weight to 70% by weight to the weight of said yellow dye image-forming coupler having Formula (I).

16. The silver halide photographic light-sensitive material of claim 1, wherein said silver halide emulsion layer contains a hydroquinone derivative together with said yellow dye image-forming coupler having Formula (I) and said high-boiling organic solvent having Formula (II).

17. The silver halide photographic light-sensitive material of claim 16, wherein said hydroquinone derivative is contained in said silver halide emulsion layer within the quantity range of from 0.001 mole to 2 moles per mole of said yellow dye image-forming coupler having Formula (I).

18. The silver halide photographic light-sensitive material of claim 17, wherein said hydroquinone derivative is contained in said silver halide emulsion layer within the quantity range of from 0.01 mole to 1 mole per mole of said yellow dye image-forming coupler having Formula (I).

19. The silver halide photographic light-sensitive material of claim 1, wherein said silver halide emulsion layer containing said yellow dye image-forming coupler having Formula (I) and/or other photographic layers contain an ultraviolet absorbing agent.

20. The silver halide photographic light-sensitive material of claim 19, wherein said ultraviolet absorbing agent is a compound having the following Formula (IX):

Formula (IX)

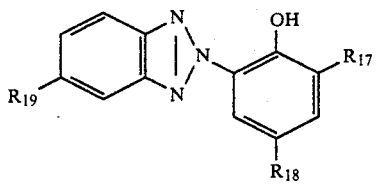

wherein $R_{17}$, $R_{18}$ and $R_{19}$ each is a hydrogen atom, a halogen atom, an alkyl radical, an aryl radical, an alkoxy radical, an aryloxy radical, an alkenyl radical, a nitro radical or a hydroxyl radical.

21. The silver halide photographic light-sensitive material of claim 1, wherein said silver halide photographic light-sensitive material contains a magenta dye image-forming coupler having the following Formula (X) and/or a cyan dye image-forming coupler having the following Formula (XI) together with said yellow dye image-forming coupler having Formula (I)

Formula (X)

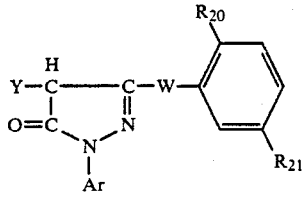

wherein Ar is an aryl radical; $R_{20}$ is a hydrogen atom, a halogen atom, an alkyl radical or an alkoxy radical; $R_{21}$ is an alkyl radical, an amido radical, an imido radical, an N-alkylcarbamoyl radical, an N-alkylsulfamoyl radical, an alkoxycarbonyl radical, an acyloxy radical, an alkylsulfonamido radical or an urethane radical; Y is a hydrogen atom or a radical that can be split off by the reaction with the oxidized product of an aromatic primary amine-type color developing agent; and W is an amino radical, an acylamino radical or an ureido radical, Formula (XI)

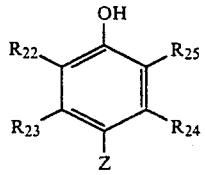

wherein Z is a hydrogen atom or a radical that can be split off by the reaction with the oxidized product of an aromatic primary amine-type color developing agent; and $R_{22}$, $R_{23}$, $R_{24}$ and $R_{25}$ each is a hydrogen atom, a halogen atom, an alkyl radical, a carbamoyl radical, a sulfamoyl radical, an amido radical, sulfonamido radical, a phosphoric acid amido radical or an ureido radical.

22. The silver halide photographic light-sensitive material of claim 1, wherein said support is baryta paper, polyethylene-coated paper, titanium oxide-containing polyethylene terephthalate support, electron beam setting resin-coated paper or polypropylene-synthetic paper.

23. The silver halide photographic light-sensitive material of claim 22, wherein said support has thereon in order at least a blue-sensitive emulsion layer, a green-sensitive emulsion layer and a red-sensitive emulsion layer, and further at least two ultraviolet absorbing agent-containing layers on the further side than said green-sensitive emulsion layer from said support.

24. A silver halide photographic light-sensitive material comprising a support having thereon at least one silver halide emulsion layer, said silver halide emulsion layer containing in combination at least one yellow dye image-forming coupler having the following Formula (I) and at least one high-boiling organic solvent having the following Formula (II):

Formula (I)

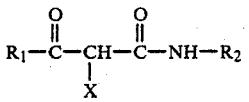

wherein $R_1$ is an alkyl radical or an aryl radical; $R_2$ is an aryl radical; and X is a radical that can be split off by the reaction with the oxidized product of an aromatic primary amine-type color developing agent, Formula (II)

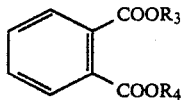

wherein $R_3$ and $R_4$ each is an alkyl radical selected from the group consisting of nonyl radical, decyl radical and undecyl radical, said $R_3$ and said $R_4$ being allowed to be either the same or different, wherein the yellow dye image coupler and the high boiling organic solvent are present in an amount effective to reduce the discoloration of a yellow dye image in a silver halide photographic light-sensitive material, wherein the radical represented by X is selected from the group consisting of Formula (IV), (V) and (VI):

$-O-R_5$ Formula (IV)

wherein $R_5$ is an aryl radical, a heterocyclic radical or an acryl radical,

Formula (V)

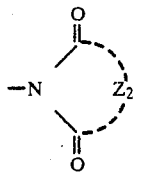

wherein $Z_2$ is a group of nonmetallic atoms capable of forming a 4- to 6-member ring together with, Formula (VI)

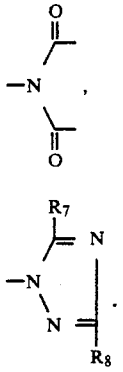

wherein $R_7$ and $R_8$ each is a hydrogen atom, a halogen atom, an alkyl radical, an alkenyl radical, an alkoxy radical, a aryl radical, a carboxy radical, an alkoxycarbonyl radical, a carbamyl radical, a sulfone radical, a sulfamyl radical, a sulfonamido radical, an acylamido radical, an ureido radical or an amino radical.

* * * * *